US009409694B2

(12) United States Patent
Duncan

(10) Patent No.: US 9,409,694 B2
(45) Date of Patent: Aug. 9, 2016

(54) MULTI-CHAMBER CONTAINER

(71) Applicant: COLGATE-PALMOLIVE COMPANY, New York, NY (US)

(72) Inventor: Kelly Gail Duncan, Washington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/442,364

(22) PCT Filed: Nov. 19, 2012

(86) PCT No.: PCT/US2012/065744

§ 371 (c)(1),
(2) Date: May 12, 2015

(87) PCT Pub. No.: WO2014/077838

PCT Pub. Date: May 22, 2014

(65) Prior Publication Data

US 2015/0329268 A1 Nov. 19, 2015

(51) Int. Cl.

| | |
|---|---|
| ***B65D 81/32*** | (2006.01) |
| ***B65D 47/20*** | (2006.01) |
| ***B65D 47/24*** | (2006.01) |

(52) U.S. Cl.

CPC ..... *B65D 81/3283* (2013.01); *B65D 47/2018* (2013.01); *B65D 47/248* (2013.01)

(58) Field of Classification Search

CPC .. B65D 35/22; B65D 35/242; B65D 47/2018; B65D 47/241; B65D 47/243; B65D 47/245; B65D 47/247; B65D 47/248; B65D 81/3283; B65D 81/3288

See application file for complete search history.

(56) References Cited

U.S. PATENT DOCUMENTS 1,848,846 A 3/1932 Schell
2,655,290 A * 10/1953 Mansperger ..... A47K 5/10 222/181.2

(Continued)

FOREIGN PATENT DOCUMENTS

GB 1 180 427 2/1970
JP H10-72051 3/1998

(Continued)

OTHER PUBLICATIONS

International Search Report and the Written Opinion issued in International Application PCT/US2012/065744 mailed Aug. 9, 2013.

*Primary Examiner* — Nicholas J Weiss

(57) ABSTRACT

Provided is a multi-chamber container for dispensing flowable substances, comprising a body and a closure movable relative to the body. The body comprises respective storage chambers for storing respective flowable substances, and a vessel defining respective outlet zones having respective outlets and a separator between the outlet zones, and movable relative to the storage chambers between a first position and a second position. The body also comprises respective inlets that fluidly connect the respective storage chambers with the respective outlet zones, and first and second members that are each movable between (a) an inactive state, at which the respective member seals a respective inlet to isolate a respective storage chamber from a respective outlet zone and a respective outlet is open so that the respective outlet zone is in fluid communication with a downstream side of the respective outlet, and (b) an active state, at which the respective member seals the respective outlet to isolate the respective outlet zone from the downstream side of the respective outlet, and the respective inlet is open so that the respective storage chamber is in fluid communication with the respective outlet zone. Movement of the vessel between the first position and the second position causes the first and second members to move between their respective inactive and active states.

32 Claims, 4 Drawing Sheets

(56) References Cited

U.S. PATENT DOCUMENTS

| | | | | | |
|---|---|---|---|---|---|
| 2,876,935 | A | | 3/1959 | Lindberg | |
| 2,980,302 | A | * | 4/1961 | Rasmussen | G01F 11/263 222/453 |
| 3,109,546 | A | * | 11/1963 | Baruh | B65D 49/00 141/352 |
| 3,323,682 | A | | 6/1967 | Creighton et al. | |
| 3,347,420 | A | | 10/1967 | Donoghue | |
| 3,581,940 | A | * | 6/1971 | Cella | B05B 11/0078 222/94 |
| 3,729,553 | A | | 4/1973 | Gold | |
| 4,065,536 | A | | 12/1977 | Lucas | |
| 4,077,547 | A | | 3/1978 | Donoghue | |
| 4,279,349 | A | | 7/1981 | Aigner | |
| 4,807,785 | A | * | 2/1989 | Pritchett | G01F 11/28 222/442 |
| 5,154,917 | A | | 10/1992 | Ibrahim | |
| 5,330,080 | A | * | 7/1994 | O'Connor | B67D 3/0035 222/181.1 |
| 5,356,040 | A | * | 10/1994 | Reggiani | B05B 11/3084 215/6 |
| 5,482,170 | A | | 1/1996 | Semersky | |
| 5,573,143 | A | | 11/1996 | Deardurff | |
| 5,593,065 | A | * | 1/1997 | Harrold | B01F 15/0454 222/145.3 |
| 5,636,765 | A | | 6/1997 | Dejonge | |
| 5,899,360 | A | | 5/1999 | Mack | |
| 5,975,364 | A | | 11/1999 | Kaufman | |
| 2015/0298865 | A1 | * | 10/2015 | Kolb | B65D 81/3283 222/145.5 |
| 2015/0353260 | A1 | * | 12/2015 | Carse | B65D 81/3283 206/221 |

FOREIGN PATENT DOCUMENTS

| | | |
|---|---|---|
| JP | 2003-128109 | 5/2003 |
| WO | WO2011/056173 | 5/2011 |
| WO | WO2012/082138 | 6/2012 |

* cited by examiner

MULTI-CHAMBER CONTAINER

CROSS-REFERENCE TO RELATED PATENT APPLICATIONS

This application is a U.S. national stage application under 35 U.S.C. §371 of PCT Application No. PCT/US2012/65744, filed Nov. 19, 2012, the entirety of which is incorporated herein by reference.

FIELD OF THE INVENTION

The present invention relates to a multi-chamber container. The multiple chambers of the container may store respective flowable substances, for example, respective oral care products such as mouthwashes or respective components of a mouthwash.

BACKGROUND OF THE INVENTION

A multi-chamber container is a container having more than one chamber for storing respective substances out of contact with one another. It may be desirable to keep the respective substances out of contact with one another during storage of the respective substances, for example if the substances might react or deteriorate over time should they be allow to mix.

Over the years, efforts have been made to improve the design of multi-chamber containers to try to prevent, during dispensing of two substances from respective chambers of the container, a first of the substances from a first of the chambers flowing into a second of the chambers holding a second of the substances causing inadvertent mixing of the substances. For example, it is known to provide a two-compartment container with two discharge openings, each leading to a respective one of the compartments, and rib members between the discharge openings to hinder a substance from the first compartment flowing into the second compartment during dispensing of the substances.

However, when using such a known container, a user may tilt the container in such a way that one of the substances flows over or around the rib members so that the substances become mixed on or in the container during a dispensing routine. Therefore, despite these efforts, a need still exists for multi-chamber container with a structure that better prevents, during dispensing of two substances from respective chambers of the container, a first of the substances stored in a first of the chambers flowing into a second of the chambers storing a second of the substances.

SUMMARY OF THE INVENTION

A first aspect of the present invention provides a multi-chamber container for dispensing flowable substances, comprising: a body having: a first storage chamber for storing a first flowable substance, a second storage chamber for storing a second flowable substance, a vessel defining a first outlet zone having a first outlet, a second outlet zone having a second outlet, and a separator between the first outlet zone and the second outlet zone, wherein the vessel is movable relative to the first and second storage chambers between a first position and a second position, a first inlet that fluidly connects the first storage chamber with the first outlet zone, a second inlet that fluidly connects the second storage chamber with the second outlet zone, a first member movable between: an inactive state, at which the first member seals the first inlet to isolate the first storage chamber from the first outlet zone, and at which the first outlet is open so that the first outlet zone is in fluid communication with a downstream side of the first outlet, and an active state, at which the first member seals the first outlet to isolate the first outlet zone from the downstream side of the first outlet, and at which the first inlet is open so that the first storage chamber is in fluid communication with the first outlet zone, and a second member movable between: an inactive state, at which the second member seals the second inlet to isolate the second storage chamber from the second outlet zone; and at which the second outlet is open so that the second outlet zone is in fluid communication with a downstream side of the second outlet, and an active state, at which the second member seals the second outlet to isolate the second outlet zone from the downstream side of the second outlet, and at which the second inlet is open so that the second storage chamber is in fluid communication with the second outlet zone, wherein movement of the vessel between the first position and the second position causes the first and second members to move between their respective inactive and active states; and a closure movable relative to the body between a closed position, at which the closure isolates the first and second outlets from an exterior of the container, and an open position, at which the first and second outlets are in fluid communication with the exterior of the container.

Preferably, movement of the vessel from the first position to the second position causes the first and second members to move from the inactive state to the active state.

Optionally, the first member is movable to a semi-active state, at which the first member seals the first inlet to isolate the first storage chamber from the first outlet zone, and at which the first member seals the first outlet to isolate the first outlet zone from the downstream side of the first outlet.

Optionally, the second member is movable to a semi-active state, at which the second member seals the second inlet to isolate the second storage chamber from the second outlet zone, and at which the second member seals the second outlet to isolate the second outlet zone from the downstream side of the second outlet.

Optionally, movement of the vessel between the first position and the second position causes the first and second members to move between the inactive and active states via the semi-active state.

Preferably, movement of the vessel from the first position to the second position causes the first and second members to move from the inactive state to the active state via the semi-active state.

The vessel may be resiliently connected to the vessel or vessels defining the first and second storage chambers. The container may comprise a biasing device for biasing the vessel to the first position.

Preferably, the first and second members are biased to the inactive state.

Optionally, the first and second inlets comprise respective first and second tubes, which first and second tubes are immovable relative to the first and second storage chambers. Optionally, the first tube is disposed in an orifice of the first storage chamber, and the second tube is disposed in an orifice of the second storage chamber.

Optionally, the body comprises a frame connected to the first and second tubes and immovable relative to the first and second storage chambers. Optionally, the vessel at least partially surrounds the frame. Optionally, the vessel at least partially surrounds the first and second inlets.

Optionally, the frame has features that cooperate with features of the vessel to guide the movement of the vessel relative to the first and second storage chambers. The vessel may be movable linearly relative to the first and second storage chambers between the first position and the second position.

Preferably, the first member is disposed in the first inlet and the second member is disposed in the second inlet.

Optionally, the first and second members are movable between the inactive state and the semi-active state without moving relative to the first and second storage chambers.

Optionally, movement of the first and second members between the inactive state and the semi-active state comprises movement of the first and second members relative to the vessel.

Optionally, the first and second members are movable between the semi-active state and the active state without moving relative to the vessel.

Optionally, movement of the first and second members between the semi-active state and the active state comprises movement of the first and second members relative to the first and second storage chambers.

Preferably, when the first and second members are in the inactive state, the first and second members are out of contact with the vessel. Preferably, movement of the vessel from the first position to the second position causes the vessel to come into contact with the first and second members. Optionally, the vessel is movable relative to the first and second members to cause the first and second members to move between the inactive state and the semi-active state, and the vessel is movable together with the first and second members relative to the first and second storage chambers to cause the first and second members to move between the semi-active state and the active state.

Preferably, the separator isolates the first outlet zone from the second outlet zone at least when the vessel is at the second position.

Optionally, the movement of the vessel between the first position and the second position causes movement of the closure relative to the first and second storage chambers. Preferably, the closure is mounted on the vessel.

Preferably, when the closure is at the closed position, the closure is spaced from the first and second outlets.

Optionally, the first and second storage chambers are defined by respective non-unitary first and second vessels, and the first and second outlet zones are defined by an apparatus that is non-unitary with the first and second vessels and is connected to the first and second vessels.

Preferably, the body has an end face and the first and second storage chambers are disposed in parallel between the vessel and the end face.

Optionally, when the closure is at the open position, the closure is detached from the body. Alternatively, when the closure is at the open position, the closure is attached to the body, such as via a hinge.

Preferably, the closure comprises a mixing chamber and, when the closure is at the closed position, the first and second outlets are in fluid communication with the mixing chamber of the closure. Alternatively, the closure comprises a first cavity, a second cavity, and a divider isolating the first cavity from the second cavity. In such an alternative, preferably, when the closure is at the closed position, the first outlet is in fluid communication with the first cavity of the closure and the second outlet is in fluid communication with the second cavity of the closure.

DETAILED DESCRIPTION OF THE PREFERRED EMBODIMENTS

Figure 1:
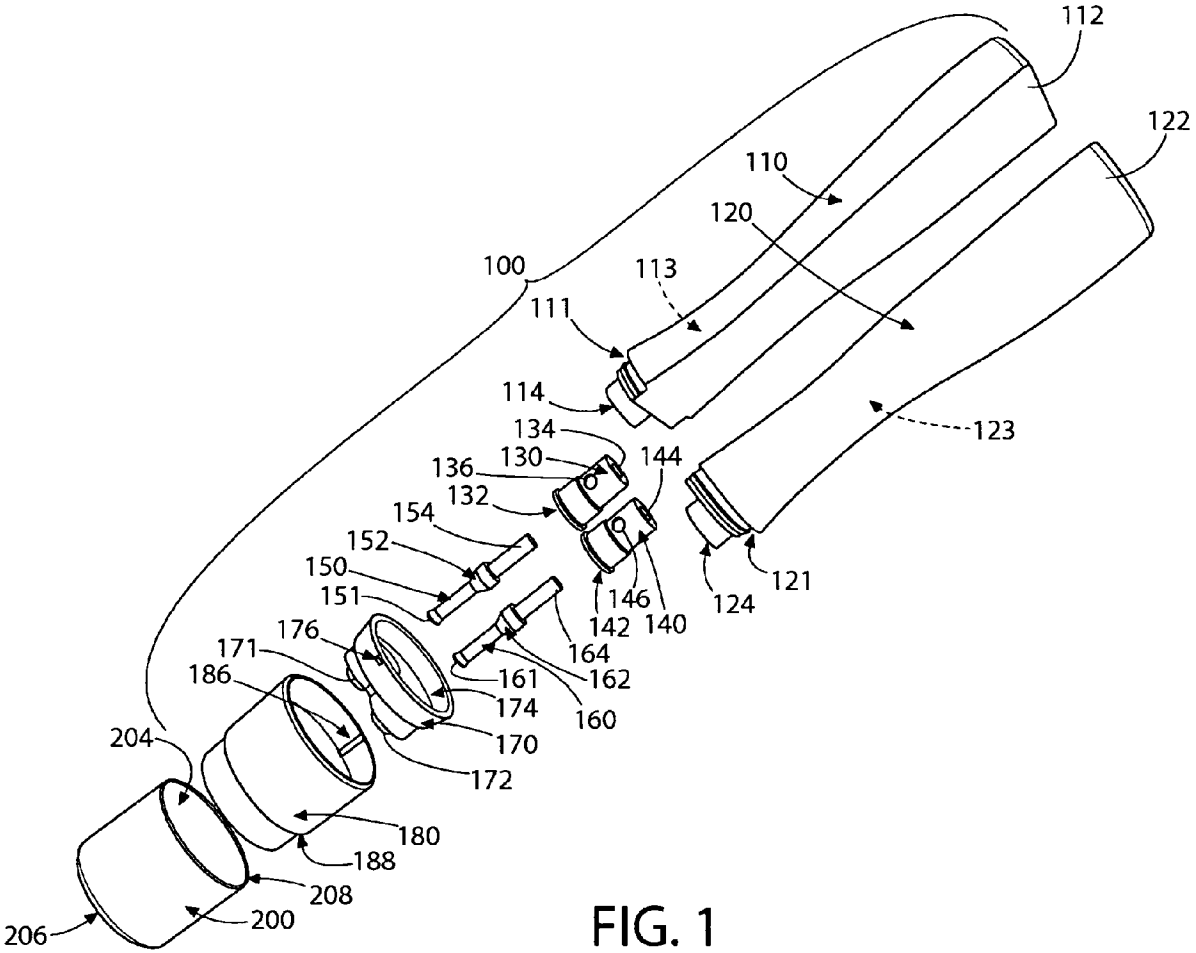
FIG. 1 is an exploded view of components of a multi-chamber container according to a first embodiment of the present invention.
Figure 2:
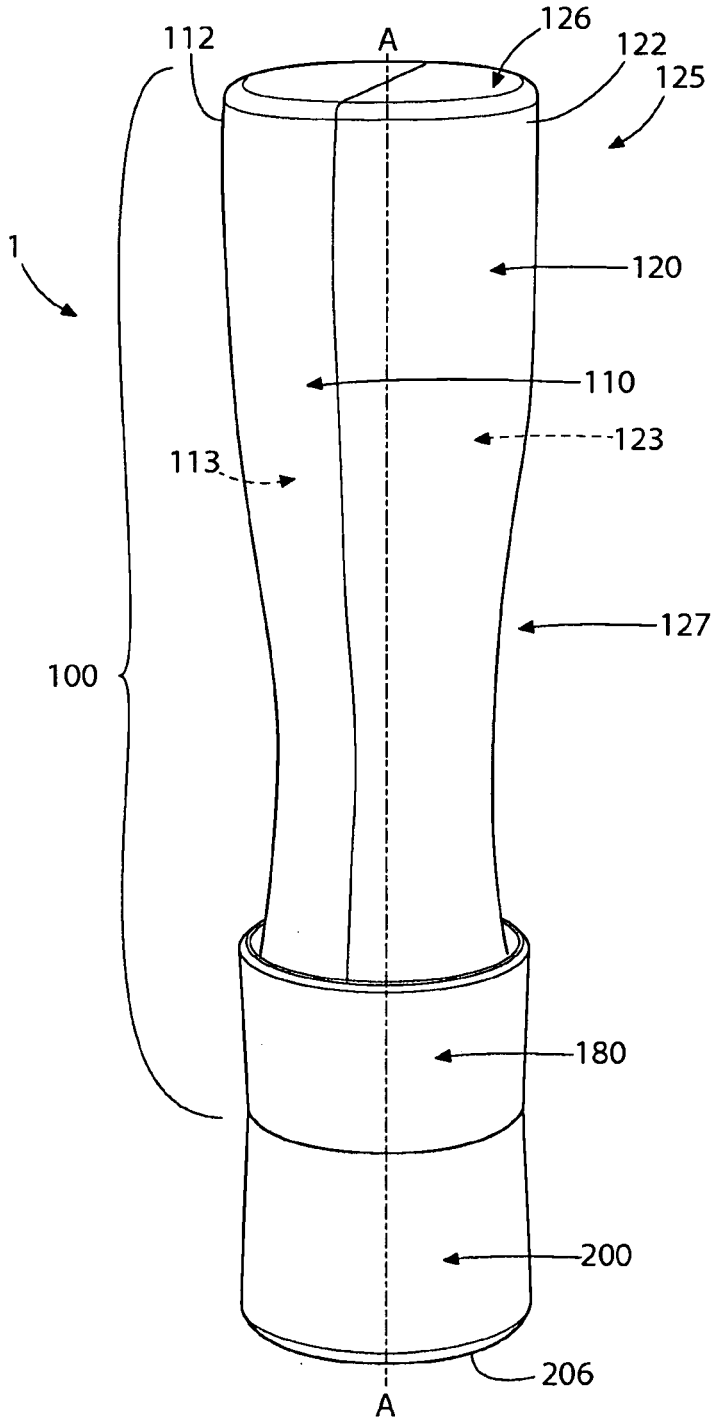
FIG. 2 is a perspective view showing the components of FIG. 2 assembled to form the multi-chamber container according to the first embodiment of the present invention, shown with the vessel of the container at its first position and the closure at its closed position.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well, as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation, unless explicitly indicated, as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

A multi-chamber container for dispensing flowable substances and according to a first embodiment of the present invention will be described with reference to FIGS. 1 to 4.

The container 1 of the first embodiment comprises a body 100 and a closure 200. The body 100 comprises first and second storage chambers 113, 123 each for storing a flowable substance, or each storing a flowable substance, such as a liquid or a paste. The storage chambers 113, 123 keep the flowable substances separate from each other, so there is no mixing of the flowable substances in the body 100 of the container 1. The flowable substances may each be an oral care product, such as a mouthwash. Alternatively, the flowable substances may be two parts of an oral care product, such as a mouthwash, that is created when the flowable substances are mixed.

The first and second storage chambers 113, 123 are defined by respective first and second vessels 110, 120 of the body 100, which first and second vessels 110, 120 have respective orifices 114, 124 at a first small end 111, 121 thereof. Each of the first and second vessels 110, 120 has a second small end 112, 122 at an end opposite to the first small end 111, 121 thereof. Together, the second small ends 112, 122 form a first longitudinal end 125 of the container 1. The first longitudinal end 125 of the container 1 has a planar end face 126, upon which the container 1 may stand on a surface when stored.

Each of the first and second vessels 110, 120 is elongate between its first and second small ends 111, 112, 121, 122. The first and second vessels 110, 120 are made from a hard, preferably rigid, material. However, in a variation to this embodiment, the first and second vessels 110, 120 are made from a flexible, preferably resilient, material. The first and second vessels 110, 120 are non-unitary. That is, the first and second vessels 110, 120 are not integrally formed together, but instead are separate components that are connected together during assembly of the container 1. In a variation to the illustrated embodiment, the first and second storage chambers 113, 123 may be respective chambers in a single, unitary vessel. Such a single, unitary vessel may be made from a hard, preferably rigid, material, or from a flexible, preferably resilient, material.

The body 100 of the container 1 further comprises an apparatus, or third vessel, 180 that is non-unitary with the first and second vessels 110, 120. The third vessel 180 is connected to the first and second vessels 110, 120 during assembly of the container 1. The third vessel 180 is resiliently connected to the first and second vessels 110, 120 via a spring or other biasing device (not shown).

The third vessel 180 defines a first outlet zone 183 having a first outlet 181, a second outlet zone 185 having a second outlet 182, and a separator 187 between the first outlet zone 183 and the second outlet zone 185. The third vessel 180 is movable relative to the first and second storage chambers 113, 123 between a first position and a second position. At least when the third vessel 180 is at the second position, the separator 187 isolates the first outlet zone 183 from the second outlet zone 185. In some embodiments, the separator 187 isolates the first outlet zone 183 from the second outlet zone 185 at all times. The biasing device (not shown) biases the third vessel 180 to its first position.

The body 100 of the container 1 further comprises first and second inlets that respectively fluidly connect the first and second storage chambers 113, 123 with the first and second outlet zones 183, 185. In this embodiment, the first and second inlets comprise respective first and second tubes 130, 140 disposed in the respective orifices 114, 124 of the first and second storage chambers 113, 123 (or of the first and second vessels 110, 120). The tubes 130, 140 are immovable relative to the first and second storage chambers 113, 123, and may be adhered to the first and second vessels 110, 120, press-fit into the respective orifices 114, 124, or otherwise fixed in the respective orifices 114, 124. Each of the tubes 130, 140 has an axially-extending internal cavity with open axial ends 132, 134, 142, 144 and one or more radially-extending holes 136, 146 in their circumferential sides, the purpose of which will be discussed below.

The body 100 also comprises a first member 150 movably disposed in and extending axially through the internal cavity of the first tube 130 and a second member 160 movably disposed in and extending axially through the internal cavity of the second tube 140. The first member 150 comprises a first rod having a first end 154 movably located in a first axial end hole 134 of the first tube 130, a second end (comprising a plug) 151 projecting through a second axial end hole 132 of the first tube 130, and a radially-extending stopper 152 approximately midway between the first and second ends 154, 151. Similarly, the second member 160 comprises a second rod having a first end 164 movably located in a first axial end hole 144 of the second tube 140, a second end (comprising a plug) 161 projecting through a second axial end hole 142 of the second tube 140, and a radially-extending stopper 162 approximately midway between the first and second ends 164, 161. The first and second members 150, 160, including their respective stoppers 152, 162, have a maximum diameter or width that is less than the internal diameter or width of the internal cavities of the respective first and second tubes 130, 140. However, the respective stoppers 152, 162, have a maximum diameter or width that is greater than the diameter or width of the respective first axial end holes 134, 144 of the first and second tubes 130, 140. Optionally, the first and second members 150, 160 seal the respective first axial end holes 134, 144 of the first and second tubes 130, 140, even during movement of the first and second members 150, 160 within the respective first axial end holes 134, 144. While not shown, in some embodiments, there may be helical springs, or other suitable elements, disposed between the interior of the first and second tubes 130, 140 and coupled to the first ends 154, 164 of the first and second members 150, 160. The helical springs may push against the respective stoppers 152, 162 to ensure the user operable movement of the first and second vessels 110, 120 between the first and second positions.

The body 100 further comprises a frame 170 substantially in the form of a collar. The frame 170 is fixed to both the first small ends 111, 121 of the first and second vessels 110, 120 and is connected to the first and second tubes 130, 140 in such a manner as to trap the first and second tubes 130, 140 between itself and the first and second vessels 110, 120. The frame 170 is immovable relative to the first and second storage chambers 113, 123. In addition to the first and second tubes 130, 140, the first and second inlets also comprise respective first and second through-holes 171, 172 formed in the frame 170. When the container 1 is assembled, the first through-hole 171 is axially aligned with the internal cavity of the first tube 130 and the second through-hole 172 is axially aligned with the internal cavity of the second tube 140. The through-holes 171, 172 have an infernal diameter or width less than that of each of the internal cavities of the first and second tubes 130, 140. The through-holes 171, 172 are scalable by the respective stoppers 152, 162, as is discussed in more detail below.

The third vessel 180 at least partially surrounds the frame 170, the first and second tubes 130, 140, and the first and second members 150, 160. Moreover, the spring or other biasing device (not shown) referred to above is connected between the third vessel 180 and the frame 170. Moreover, the frame 170 has features 176 (in this embodiment in the form of a pair of projections, although only one in shown in FIG. 1) that cooperate with features 186 (in this embodiment in the form of a pair of longitudinally-extending grooves, although only one in shown in FIG. 1) of the third vessel 180 to guide the movement of the third vessel 180 relative to the first and second storage chambers 113, 123. Due to the cooperation between the features 176 of the frame 170 and of the third vessel 180, the third vessel 180 is movable linearly in a longitudinal direction of the container 1 relative to the first and second storage chambers 113, 123 between the first position and the second position.

As mentioned above, the container 1 also comprises a closure 200. The closure 200 is a cup that is movable relative to the body 100 between a closed position, at which the closure 200 isolates the first and second outlets 181, 182 from an exterior of the container 1, and an open position, at which the first and second outlets 181, 182 are in fluid communication with the exterior of the container 1. When the closure 200 is at the open position, the closure 200 is detached from the body 100. However, when the closure 200 is at the closed position, the closure 200 is mounted on the third vessel 180 with a rim 208 of the closure 200 mating with an edge 188 of the third vessel 180. When mounted on the third vessel 180 at the closed position, the closure 200 is spaced from the first and second outlets 181, 182. The closure 200 includes a planar face 206, upon which the container 1 may stand on a surface, particularly during a dispensing operation.

In this embodiment, the closure 200 comprises a mixing chamber 204 and, when the closure 200 is at the closed position, the first and second outlets 181, 182 are in fluid communication with the mixing chamber 204 of the closure 200 so that any substances flowing through the first and second outlets 181, 182 into the mixing chamber 204 are permitted to mix in the mixing chamber 204. The closure-side of the first and second outlets 181, 182 is considered the downstream side of the first and second outlets 181, 182 herein. That is, the mixing chamber 204 is downstream of the first and second outlets 181, 182.

In a variation to this embodiment, the closure 200 comprises a first cavity, a second cavity, and a divider isolating the first cavity from the second cavity and, when the closure is at the closed position, the first outlet is in fluid communication with the first cavity of the closure and the second outlet is in fluid communication with the second cavity of the closure, so that the first and second cavities of the closure are downstream of the respective first and second outlets 181, 182. Accordingly, in such a variation, the divider prevents mixing in the closure 200 of any substances flowing through the first and second outlets 181, 182 into the first and second cavities of the closure 200.

During assembly of the multi-chamber container 1, the first and second tubes 130, 140 are inserted into the respective first and second orifices 114, 124, the first and second members 150, 160 are inserted into the internal cavities of the respective first and second tubes 130, 140, the first and second vessels 110, 120 are brought into contact with each other, and their respective first small ends 111, 121 and orifices 114, 124 are inserted into a receiving hole 174 formed in a first side of the frame 170. The respective first small ends 111, 121 of the first and second vessels 110, 120 are then fixed to the frame 170, such as by adherence using adhesive or by sonic welding the frame 170 to the first and second vessels 110, 120. The third vessel 180 then is resiliently connected to the frame 170 by the biasing device (not shown), and the closure 200 is mounted to the third vessel 180. Accordingly, in the assembled container 1, the first and second storage chambers 113, 123 are disposed in parallel between the end face 126 and each of the frame 170, the third vessel 180 and the closure 200.

In the variation in which the first and second storage chambers 113, 123 are respective chambers in a single, unitary vessel, each of the frame 170 and the third vessel 180 and may be non-unitary with the single, unitary vessel, and may be connected to the single, unitary vessel during assembly of the container 1.

Overall, the container 1 is elongate with a longitudinal axis A-A that extends through the end face 126 and through each of the frame 170, third vessel 180, and closure 200. The end 125 and the closure 200 are disposed at, and define, respective first and second longitudinal ends of the container 1, when the closure 200 is at the closed position. In this embodiment, the longitudinal axis A-A is orthogonal to the end face 126. Further, the container 1 has an hourglass shape, which enables a user to take a firm hold of the container 1 during transport and use. In this embodiment, the hourglass shape is achieved by the first and second vessels 110, 120 together defining a waist 127 of the body 100 of the container 1, which waist 127 has a smaller lateral cross sectional area than each of the end 125 and the third vessel 180.

As discussed above, the first and second members 150, 160 are movably disposed in the first and second tubes 130, 140. The first and second members 150, 160 are movable to seal and open the first and second inlets and the first and second outlets 181, 182.

More specifically, the first member 150 is movable between (a) an inactive state or position (see FIG. 3), at which the stopper 152 of the first member 150 seals the first through-hole 171 of the first inlet to isolate the first storage chamber 113 from the first outlet zone 183, and at which the first outlet 181 is open so that the first outlet zone 183 is in fluid communication with a downstream side (in the mixing chamber 204 of the closure 200) of the first outlet 181, and (b) an active state or position (see FIG. 4), at which the plug 151 of the first member 150 seals the first outlet 181 to isolate the first outlet zone 183 from the downstream side of the first outlet 181, and at which the first inlet is open so that the first storage chamber 113 is in fluid communication with the first outlet zone 183. Similarly, the second member 160 is movable between (a) an inactive state or position (see FIG. 3), at which the stopper 162 of the second member 160 seals the second through-hole 172 of the second inlet to isolate the second storage chamber 123 from the second outlet zone 185, and at which the second outlet 182 is open so that the second outlet zone 185 is in fluid communication with a downstream side (in the mixing chamber 204 of the closure 200) of the second outlet 182, and (b) an active state or position (see FIG. 4), at which the plug 161 of the second member 160 seals the second outlet 182 to isolate the second outlet zone 185 from the downstream side of the second outlet 182, and at which the first inlet is open so that the second storage chamber 123 is in fluid communication with the second outlet zone 185. The first and second members 150, 160 are biased to their respective inactive states by a, or respective, resilient apparatuses (not shown) of the container 1. When the first and second members 150, 160 are in their respective inactive states, the internal cavities of the first and second tubes 130, 140, on the opposite side of the respective stoppers 152, 162 to the first and second through-holes 171, 172, are in fluid communication with the respective storage chambers 113, 123 via the radially-extending holes 136, 146 in the circumferential sides of the tubes 130, 140.

Moreover, in this embodiment, the first member 150 is movable to a semi-active state or position, at which the stopper 152 of the first member 150 seals the first inlet to isolate the first storage chamber 113 from the first outlet zone 183, and at which the plug 151 of the first member 150 seals the first outlet 181 to isolate the first outlet zone 183 from the downstream side of the first outlet 181. Similarly, the second member 160 is movable to a semi-active state or position, at which the stopper 162 of the second member 160 seals the second inlet to isolate the second storage chamber 123 from the second outlet zone 185, and at which the plug 161 of the second member 160 seals the second outlet 182 to isolate the second outlet zone 185 from the downstream side of the second outlet 182.

The first and second members 150, 160 are movable between their respective inactive and active states or positions via their respective semi-active states or positions. More specifically, movement of the third vessel 180, relative to the first and second storage chambers 113, 123 and against the biasing force of the biasing device (not shown), between the first position and the second position causes the first and second members 150, 160 to move between their respective inactive and active states or positions via their respective semi-active states or positions. When the third vessel 180 is at the first position, the first and second members 150, 160 are at their respective inactive positions and, when the third vessel 180 is at the second position, the first and second members 150, 160 are at their respective active positions. Movement of the third vessel 180, relative to the first and second storage chambers 113, 123 and against the biasing force of the biasing device (not shown), from the first position to the second position causes the first and second members 150, 160 to move from their respective inactive states to their respective active states via their respective semi-active states. Since the closure 200 is mounted on the third vessel 180, movement of the third vessel 180 between the first position and the second position causes movement of the closure 200 relative to the first and second storage chambers 113, 123.

Figure 3:
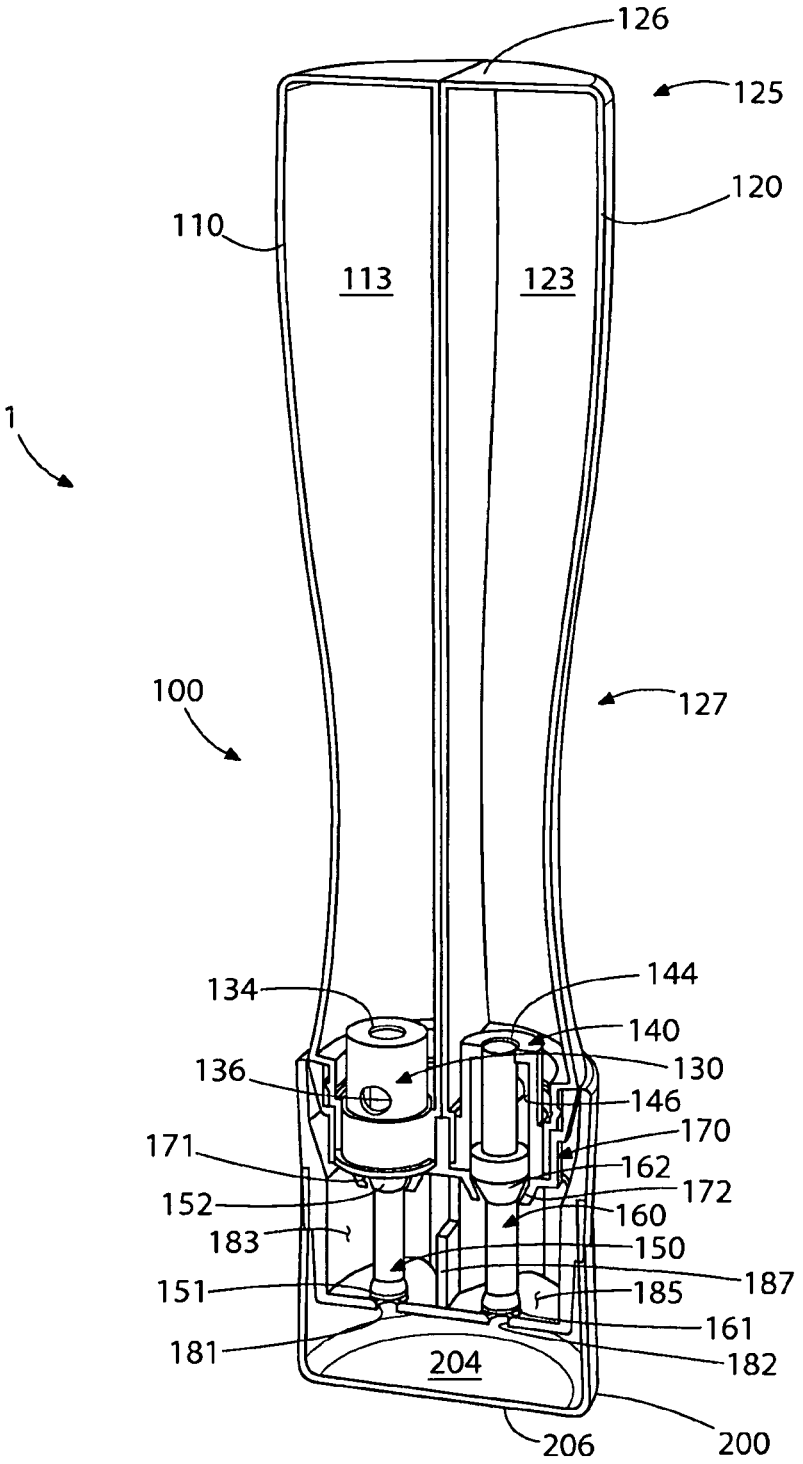
FIG. 3 is a cross-sectional view of the multi-chamber container of FIG. 2, shown with the vessel of the container at its first position, the first and second members at the inactive state, and the closure at its closed position.

When the first and second members 150, 160 are in their respective inactive states, the first and second members 150, 160 are out of contact with the third vessel 180, as shown in FIG. 3. However, movement of the third vessel 180 from the first position to the second position causes the third vessel 180 to come into contact with the first and second members 150, 160. The third vessel 180 is movable relative to the first and second members 150, 160 to cause the first and second members 150, 160 to move between their respective inactive states and their respective semi-active states. More specifically, this movement causes the plugs 151, 161 of the first and second members 150, 160 to contact the third vessel 180 around the first and second outlets 181, 182 in order to seal the first and second outlets 181, 182. Accordingly, movement of the first and second members 150, 160 between their respective inactive states and their respective semi-active states comprises movement of the first and second members 150, 160 relative to the third vessel 180. However, the first and second members 150, 160 move between their respective inactive states and their respective semi-active states without moving relative to the first and second storage chambers 113, 123.

The third vessel 180 also is movable together with the first and second members 150, 160 relative to the first and second storage chambers 113, 123 to cause the first and second members 150,160 to move between their respective semi-active states and their respective active states. More specifically, this movement causes the stoppers 152, 162 of the first and second members 150, 160 to unseal the first and second through-holes 171, 172 to unseal the first and second inlets. As the first and second members 150, 160 are moved from their respective semi-active states to their respective active states, the first ends 154, 164 of the first and second members 150, 160 move through the first axial end holes 134, 144 of the first and second tubes 130, 140 into the first and second storage chambers 113, 123.

The first and second members 150, 160 thus are movable between their respective semi-active states and their respective active states without moving relative to the third vessel 180, but movement of the first and second members 150, 160 between their respective semi-active states and their respective active states comprises movement of the first and second members 150, 160 relative to the first and second storage chambers 113, 123.

It is possible to dispense the first and second flowable substances from the container 1 with the closure 200 at the open position. However, when a user wishes to dispense the first and second flowable substances from the container 1, preferably they ensure that the closure 200 is mounted to the third vessel 180 in its closed position and that the container 1 is disposed with the closure 200 lowermost. For example, the container 1 may be stood on a surface via its planar face 206. In any event, the container 1 should be held with the third vessel 180 below the first and second storage chambers 113, 123. The first and second members 150, 160 are biased to their respective inactive states and the third vessel 180 is biased to its first position so, prior to the dispensing taking place, the container 1 is in the state shown in FIGS. 2 and 3 with the first and second inlets sealed by the stoppers 152, 162 of the first and second members 150, 160, which are in their inactive states.

The user then applies a force to the body 100 with a component in the direction of the longitudinal axis A-A from the first longitudinal end 125 towards the third vessel 180. For example, the user may press down on the planar end face 126. This causes the storage chambers 113, 123, the frame 170 and the first and second members 150, 160 to move towards the third vessel 180 against the biasing force of the biasing device (not shown), which in turn causes the plugs 151, 161 of the first and second members 150, 160 to come into contact with the third vessel 180 and seal the first and second outlets 181, 182. The stoppers 152, 162 continue to seal the first and second inlets. The first and second members 150, 160 are thus in their semi-active states.

Figure 4:
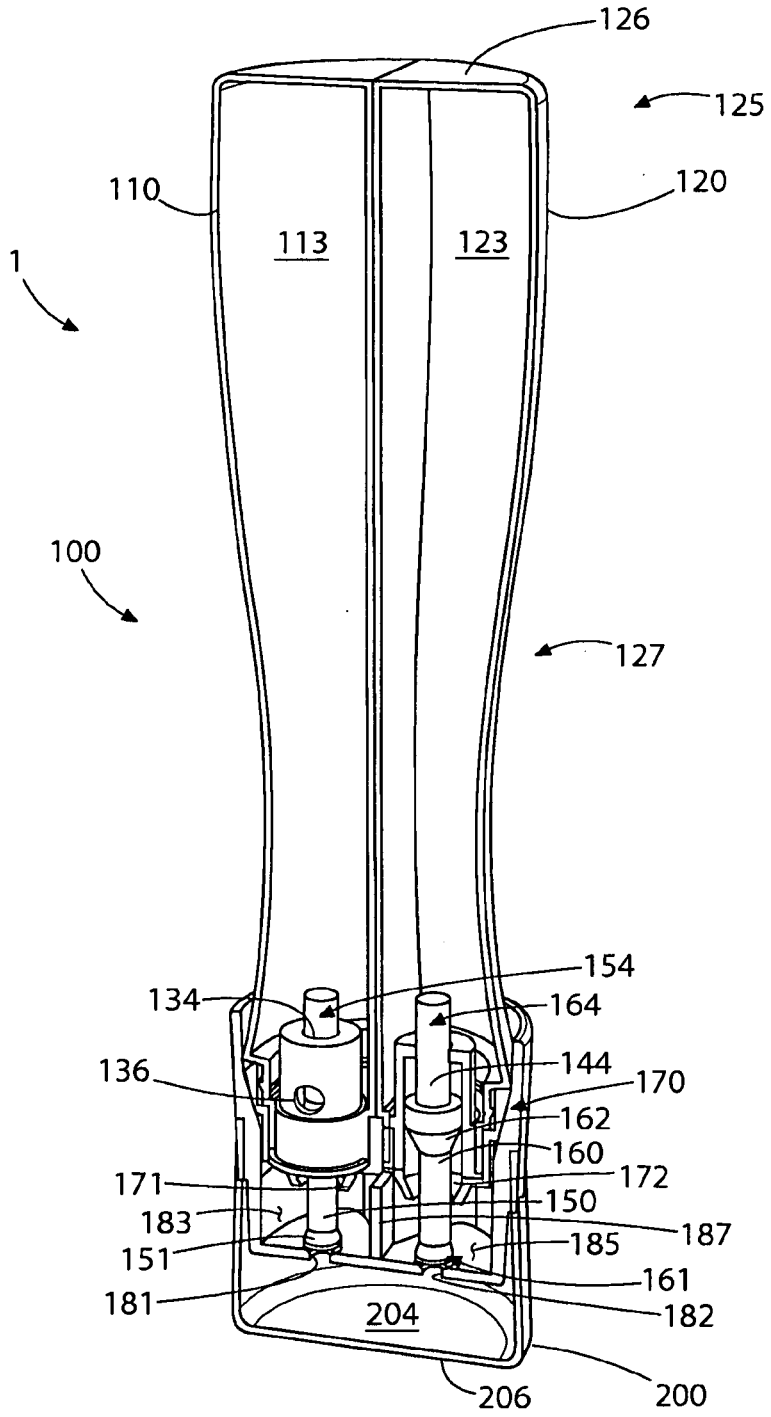
FIG. 4 is a cross-sectional view of the multi-chamber container of FIG. 3, shown with the vessel of the container at its second position, the first and second members at the active state, and the closure at its closed position.

By the user continuing the application of the force, or by applying a greater force in the same direction, the storage chambers 113, 123 and the frame 170 continue to move towards the third vessel 180 until the third vessel 180 reaches the second position relative to the storage chambers 113, 123. However, since the first and second members 150, 160 are in contact with the third vessel 180, the first and second members 150, 160 do not move further relative to the third vessel 180. Rather, the storage chambers 113, 123 and the frame 170 move relative to the first and second members 150, 160, against the biasing force of the resilient apparatus(es) (not shown), which in turn causes the stoppers 152, 162 of the first and second members 150, 160 to unseal the first and second through-holes 171, 172, i.e. to unseal or open the first and second inlets. The plugs 151, 161 continue to seal the first and second outlets 181, 182. The first and second members 150, 160 are thus in their active states, as shown in FIG. 4.

With the first and second members 150, 160 in their respective active states, the first and second flowable substances in the respective storage chambers 113, 123 are free to flow into the respective first and second outlet zones 183, 185 via the first and second inlets. However, since the first and second outlets 181, 182 are sealed, only respective predetermined volumes (corresponding to the respective volumes of the first and second outlet zones 183, 185 when the third vessel 180 is at its second position) of the first and second flowable substances are containable in the first and second outlet zones 183, 185. In this embodiment, the predetermined volumes are equal to each other. That is, the respective volumes of the first and second outlet zones 183, 185 when the third vessel 180 is at its second position may be equal to each other. In other embodiments, the predetermined volumes are unequal to each other and the respective volumes of the first and second outlet zones 183, 185 when the third vessel 180 is at its second position are unequal to each other.

When these predetermined volumes of the first and second flowable substances are present in the first and second outlet zones 183, 185, the user may reduce or remove the applied force. Under the biasing forces of the biasing device and the biasing apparatus(es), the third vessel 180 moves from its second position to its original first position, and the first and second members 150, 160 move from their respective active positions to their respective inactive positions. During these movements, the stoppers 152, 162 seal the first and second inlets prior to the plugs 151, 161 unsealing the first and second outlets 181, 182, when the first and second members 150, 160 reach their respective semi-active positions. Therefore, with the first and second members 150, 160 in their respective semi-active positions, the predetermined volumes of the first and second flowable substances are isolated from each other (by the separator 127), from the storage chambers 113, 123 (by the stoppers 152, 162) and from the mixing chamber 204 (by the plugs 151, 161).

As the third vessel 180 reaches its first position and the first and second members 150, 160 reach their respective inactive positions, the plugs 151, 161 unseal the first and second outlets 181, 182. This permits the predetermined volumes of the first and second flowable substances to flow through the respective first and second outlets 181, 182 into the mixing chamber 204 of the closure 200, where they are then able to mix.

The user then carefully removes the closure 200 from the third vessel 180, brings the rim 208 of the closure 200 to their lips, and pours the mixed first and second flowable substances into their mouth.

Since the first and second flowable substances are kept isolated from each other in the body 100, mixing of the first and second flowable substances in the body 100 is prevented and contamination of the first inlet, first storage chamber 113 and first outlet zone 183 with the second flowable substance is avoided. Similarly, contamination of the second inlet, second storage chamber 123 and second outlet zone 185 with the first flowable substance is avoided.

In the variation to the described embodiment in which the closure 200 comprises a first cavity, a second cavity, and a divider isolating the first cavity from the second cavity, mixing of the first and second flowable substances in the whole container 1 is preventable. The user could bring the rim 208 of the closure 200 to their lips and pour the unmixed first and second flowable substances into their mouth as separate flows.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

The invention claimed is:

1. A multi-chamber container for dispensing flowable substances, comprising:

a body having:

a first storage chamber for storing a first flowable substance, a second storage chamber for storing a second flowable substance, a vessel defining a first outlet zone having a first outlet, a second outlet zone having a second outlet, and a separator between the first outlet zone and the second outlet zone, wherein the vessel is movable relative to the first and second storage chambers between a first position and a second position, a first inlet that fluidly connects the first storage chamber with the first outlet zone, a second inlet that fluidly connects the second storage chamber with the second outlet zone, a first member movable between:

an inactive state, at which the first member seals the first inlet to isolate the first storage chamber from the first outlet zone, and at which the first outlet is open so that the first outlet zone is in fluid communication with a downstream side of the first outlet, and an active state, at which the first member seals the first outlet to isolate the first outlet zone from the downstream side of the first outlet, and at which the first inlet is open so that the first storage chamber is in fluid communication with the first outlet zone, and a second member movable between:

an inactive state, at which the second member seals the second inlet to isolate the second storage chamber from the second outlet zone, and at which the second outlet is open so that the second outlet zone is in fluid communication with a downstream side of the second outlet, and an active state, at which the second member seals the second outlet to isolate the second outlet zone from the downstream side of the second outlet, and at which the second inlet is open so that the second storage chamber is in fluid communication with the second outlet zone, wherein movement of the vessel between the first position and the second position causes the first and second members to move between their respective inactive and active states; and a closure movable relative to the body between a closed position, at which the closure isolates the first and second outlets from an exterior of the container, and an open position, at which the first and second outlets are in fluid communication with the exterior of the container.

2. The container of claim 1, wherein movement of the vessel from the first position to the second position causes the first and second members to move from their respective inactive states to their respective active states.

3. The container of claim 1, wherein the first member is movable to a semi-active state, at which the first member seals the first inlet to isolate the first storage chamber from the first outlet zone, and at which the first member seals the first outlet to isolate the first outlet zone from the downstream side of the first outlet;

wherein the second member is movable to a semi-active state, at which the second member seals the second inlet to isolate the second storage chamber from the second outlet zone, and at which the second member seals the second outlet to isolate the second outlet zone from the downstream side of the second outlet; and wherein movement of the vessel between the first position and the second position causes the first and second members to move between their respective inactive and active states via their respective semi-active states.

4. The container of claim 3, wherein movement of the vessel from the first position to the second position causes the first and second members to move from their respective inactive states to their respective active states via their respective semi-active states.

5. The container of claim 1, wherein the vessel is resiliently connected to a vessel or vessels defining the first and second storage chambers.

6. The container of claim 1, comprising a biasing device for biasing the vessel to the first position.

7. The container of claim 1, wherein the first and second members are biased to their respective inactive states.

8. The container of claim 1, wherein the first and second inlets comprise respective first and second tubes, which first and second tubes are immovable relative to the first and second storage chambers.

9. The container of claim 8, wherein the first tube is disposed in an orifice of the first storage chamber, and the second tube is disposed in an orifice of the second storage chamber.

10. The container of claim 8, wherein the body comprises a frame connected to the first and second tubes and immovable relative to the first and second storage chambers.

11. The container of claim 10, wherein the vessel at least partially surrounds the frame.

12. The container of claim 1, wherein the vessel at least partially surrounds the first and second inlets.

13. The container of claim 10, wherein the frame has features that cooperate with features of the vessel to guide the movement of the vessel relative to the first and second storage chambers.

14. The container of claim 1, wherein the vessel is movable linearly relative to the first and second storage chambers between the first position and the second position.

15. The container of claim 1, wherein the first member is disposed in the first inlet and the second member is disposed in the second inlet.

16. The container of claim 3, wherein the first and second members are movable between their respective inactive states and their respective semi-active states without moving relative to the first and second storage chambers.

17. The container of claim 3, wherein movement of the first and second members between their respective inactive states and their respective semi-active states comprises movement of the first and second members relative to the vessel.

18. The container of claim 3, wherein the first and second members are movable between their respective semi-active states and their respective active states without moving relative to the vessel.

19. The container of claim 3, wherein movement of the first and second members between their respective semi-active states and their respective active states comprises movement of the first and second members relative to the first and second storage chambers.

20. The container of claim 1 wherein, when the first and second members are in their respective inactive states, the first and second members are out of contact with the vessel.

21. The container of claim 1, wherein movement of the vessel from the first position to the second position causes the vessel to come into contact with the first and second members.

22. The container of claim 3, wherein the vessel is movable relative to the first and second members to cause the first and second members to move between their respective inactive states and their respective semi-active states, and wherein the vessel is movable together with the first and second members relative to the first and second storage chambers to cause the first and second members to move between their respective semi-active states and their respective active states.

23. The container of claim 1, wherein the separator isolates the first outlet zone from the second outlet zone at least when the vessel is at the second position.

24. The container of claim 1, wherein the movement of the vessel between the first position and the second position causes movement of the closure relative to the first and second storage chambers.

25. The container of claim 1, wherein the closure is mounted on the vessel.

26. The container of claim 1 wherein, when the closure is at the closed position, the closure is spaced from the first and second outlets.

27. The container of claim 1, wherein the first and second storage chambers are defined by respective non-unitary first and second vessels, and the vessel, defining the first and second outlet zones, is non-unitary with the first and second vessels and is connected to the first and second vessels.

28. The container of claim 1, wherein the body has an end face and the first and second storage chambers are disposed in parallel between the vessel and the end face.

29. The container of claim 1 wherein, when the closure is at the open position, the closure is detached from the body.

30. The container of claim 1, wherein the closure comprises a mixing chamber and, when the closure is at the closed position, the first and second outlets are in fluid communication with the mixing chamber of the closure.

31. The container of claim 1, wherein the closure comprises a first cavity, a second cavity, and a divider isolating the first cavity from the second cavity.

32. The container of claim 31 wherein, when the closure is at the closed position, the first outlet is in fluid communication with the first cavity of the closure and the second outlet is in fluid communication with the second cavity of the closure.

* * * * *